US005265767A

United States Patent [19]

Gustafson

[11] Patent Number: 5,265,767

[45] Date of Patent: Nov. 30, 1993

[54] CONTAINER AND DISPENSER FOR TWO BEVERAGES

[75] Inventor: David R. Gustafson, St. Louis Park, Minn.

[73] Assignee: Split Second Coffee Industries Inc., Shoreview, Minn.

[21] Appl. No.: 964,499

[22] Filed: Oct. 21, 1992

Related U.S. Application Data

[63] Continuation-in-part of Ser. No. 786,371, Nov. 1, 1991, abandoned, which is a continuation-in-part of Ser. No. 712,595, Jun. 10, 1991, abandoned.

[51] Int. Cl.[5] ..... B67D 5/60

[52] U.S. Cl. ..... 222/144.5; 222/471; 222/473; 222/475.1; 222/145; 222/545; 222/556; 222/559

[58] Field of Search ..... 222/469, 470, 472, 473, 222/474, 475.1, 144.5, 145, 129, 482–485, 510, 517, 545, 556

[56] References Cited

U.S. PATENT DOCUMENTS

| | | | |
|---|---|---|---|
| 695,173 | 3/1902 | Rohrbacher et al. | 222/145 |
| 756,373 | 4/1904 | Joyce | 222/470 |
| 803,964 | 11/1905 | Baker | 222/474 |
| 1,025,653 | 5/1912 | Sims | 222/144.5 |
| 1,030,752 | 6/1912 | Sherman . | |
| 1,393,250 | 10/1921 | Sharbaugh | 222/473 X |
| 2,040,087 | 5/1936 | Hackl | 222/473 X |
| 2,331,380 | 10/1943 | Edey | 222/473 X |
| 2,554,293 | 5/1951 | Brown | 222/470 |
| 3,847,311 | 11/1974 | Flores et al. | 222/473 |
| 3,971,304 | 7/1976 | Cvitkovich | 99/291 |
| 4,303,173 | 12/1981 | Nergard | 222/470 X |
| 4,648,535 | 3/1987 | Zimmermann | 222/472 |
| 4,651,900 | 3/1987 | Horvath et al. | 222/144.5 |
| 4,676,411 | 6/1987 | Simaski | 222/472 X |
| 4,703,871 | 11/1987 | Broker | 222/144.5 |
| 4,750,644 | 6/1988 | Kolody | 222/144.5 |
| 4,773,563 | 9/1988 | Taylor | 222/144.5 |
| 4,802,406 | 2/1989 | Bouldin | 222/475.1 X |
| 5,025,939 | 6/1991 | Bunn et al. | 215/100 A |
| 5,037,015 | 8/1991 | Collins | 222/472 |
| 5,072,858 | 12/1991 | Brashien | 222/144.5 |
| 5,118,014 | 6/1992 | Hestehave et al. | 222/472 |
| 5,188,019 | 2/1993 | Vahabpour | 222/144.5 X |
| 5,222,623 | 6/1993 | Eger et al. | 222/472 X |

FOREIGN PATENT DOCUMENTS

| | | | |
|---|---|---|---|
| 48809 | 9/1988 | France | 222/144.5 |
| 2612579 | 9/1988 | France . | |
| 19809 | 8/1908 | United Kingdom . | |

*Primary Examiner*—Andres Kashnikow
*Assistant Examiner*—Kenneth DeRosa
*Attorney, Agent, or Firm*—James V. Harmon

[57] ABSTRACT

A container for selectively dispensing one of two beverages is includes a liquid holding vessel having an upper open mouth at the top and a vertically disposed partition to divide the vessel into a pair of laterally disposed left and right compartments for two different beverages. A cover is provided to fit within the mouth at the top of the vessel. The partition has a horizontally disposed sealing edge at the top between the compartments. The cover has a corresponding diametrically extending sealing surface adapted to engage the sealing edge of the partition to form a seal to prevent mixing of the contents of the compartments when the cover is in place on the container. Left and right valves are provided in a lower surface of the cover on opposite sides of the seal between the partition and the cover. The cover has an outlet duct so that when one of the valves in the lower surface of the cover is opened the beverage can be dispensed through the outlet duct from a corresponding chamber in the vessel.

7 Claims, 8 Drawing Sheets

CONTAINER AND DISPENSER FOR TWO BEVERAGES

This is a continuation-in-part of my prior application Ser. No. 07/786,371, filed Nov. 1, 1991, now abandoned, which was a continuation-in-part of application Ser. No. 07/712,595, filed Jun. 10, 1991, now abandoned, and bearing the same title.

FIELD OF THE INVENTION

The invention relates to beverage dispensing and more particularly to a beverage container or pitcher that can be carried in one hand with provision for selectively dispensing either of two beverages.

BACKGROUND OF THE INVENTION

Because of the popularity of decaffeinated coffee, it is common in restaurants to have two pots or pitchers available for customers, one containing regular coffee and the other decaffeinated coffee. Portable coffee pots have been proposed for use in restaurants and cafeterias for dispensing two beverages, but previous dispensers have been complicated in construction and difficult to fill or keep clean, or are difficult to operate because they require an awkward movement of the thumb or finger to dispense beverages selectively. Some of these containers have a very small top opening, making them difficult to fill and clean. Others do not allow two beverages to be heated to the same degree when the container is placed on a hot plate.

In view of these and other deficiencies of the prior art, it is one object to eliminate operating rods or other moving parts previously provided in some dispensing containers within the portion of the container that holds liquid where the moving parts are exposed to the contents of the container. In a coffee dispenser, the presence of moving parts in contact with the coffee is regarded by some as a potential sanitation problem.

Another object is to eliminate operating rods and valves that are exposed to view inside the container when the cover of the container is removed or the need to have for operating levers in the handle of the container.

A more specific object is to provide a dispensing container for both regular and decaffeinated coffee in which both operating levers and valves are contained entirely within the cover.

A further object is to provide a dispensing container for two beverages in which the vessel itself is simply constructed with clean lines and smooth surfaces that can be readily cleaned and in which the entire container can be washed in a standard dishwasher.

Yet a further object is to provide a portable container and dispenser for two beverages, such as regular and decaffeinated coffee, that has a wide open top to facilitate easy filling and that does not have to be disassembled to be filled.

It is another important object of the invention to allow the dispensing of two different beverages by two separate selectively operable dispensing levers that are easy to operate with the thumb, viz. in one form of the invention with a simple grasping or gripping movement of the thumb wherein the thumb is moved downwardly toward the center of the hand in a natural way.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

In one preferred form of the invention, a divided serving container is provided for selectively dispensing one of two beverages. The beverage serving container includes a liquid holding vessel having an upper open mouth at the top and a vertically disposed partition to divide the container into a pair of laterally disposed left and right compartments. A cover fits within the mouth at the top of the container, and the partition has a horizontally disposed upper sealing edge between the compartments. The cover has a diametrically extending lower sealing surface positioned to engage the sealing edge of the partition to form a seal to prevent mixing of the beverages in the compartments when the cover is in place on the container. Left and right valves are provided in a lower surface of the cover on either side of the sealing surface. A duct communicates between the valves and an outlet within the cover so that when one of the valves is opened the beverage can be dispensed from a corresponding chamber in the vessel through the outlet duct of the cover.

In another form of the invention, a pair of dispensing levers are mounted on the handle in position to be operated alternatively, i.e., selectively, while the user holds the handle. There is a pour spout mounted on an outside surface of the neck so that a portion of the neck comprises a septum between the space inside the neck and the pour spout. The septum has openings on each side of the partition. A movable valve is provided in each opening in the septum. Two elongated actuator members are located in the neck on opposite sides of the partition to connect the actuator levers and the valve members for allowing a selected valve to be opened by moving one of the levers so that the beverages can be dispensed from the chambers selectively.

THE FIGURES

Figure 8:
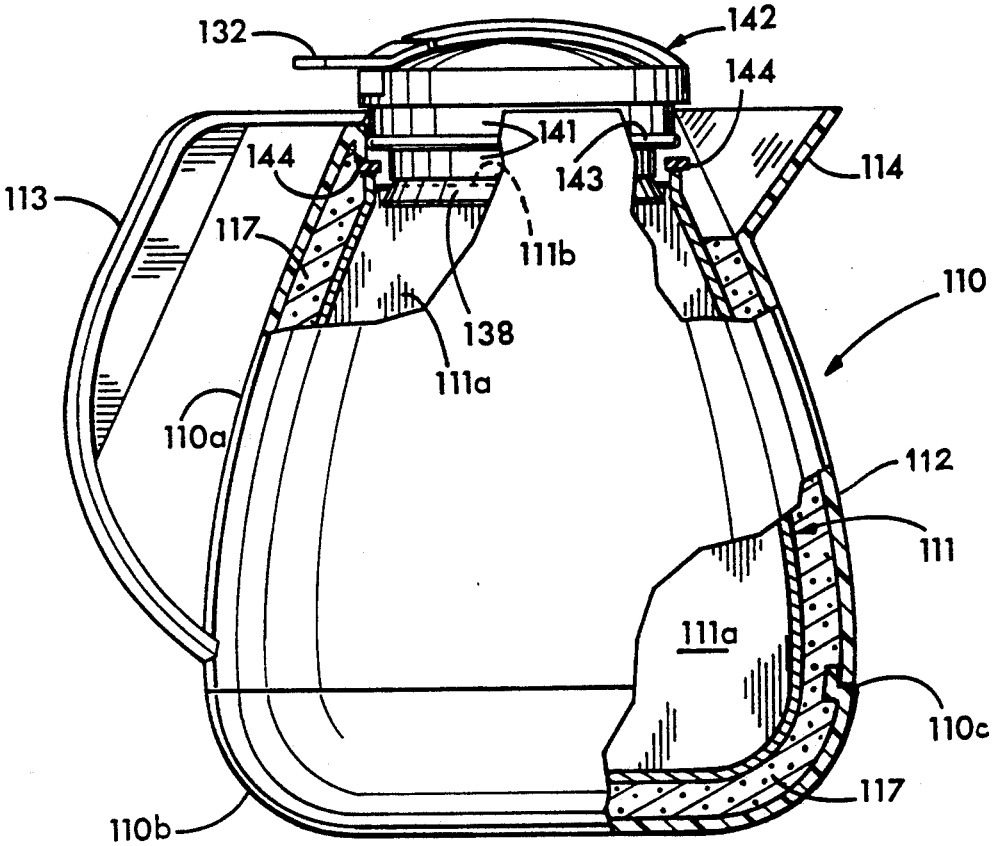
FIG. 8 is a side elevational view partly in section of another form of the invention.
Figure 10:
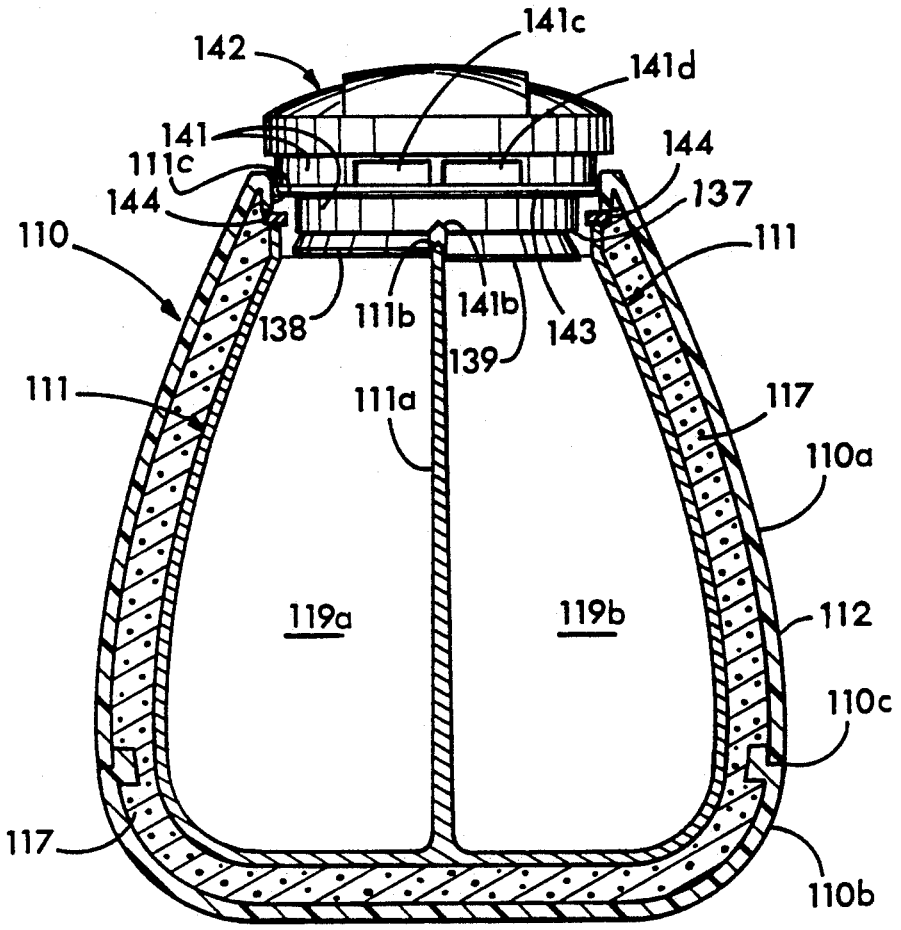
FIG. 10 is a vertical sectional view taken on line 10—10 of FIG. 9.
Figure 10A:
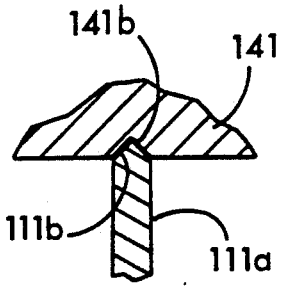
Figure 11:
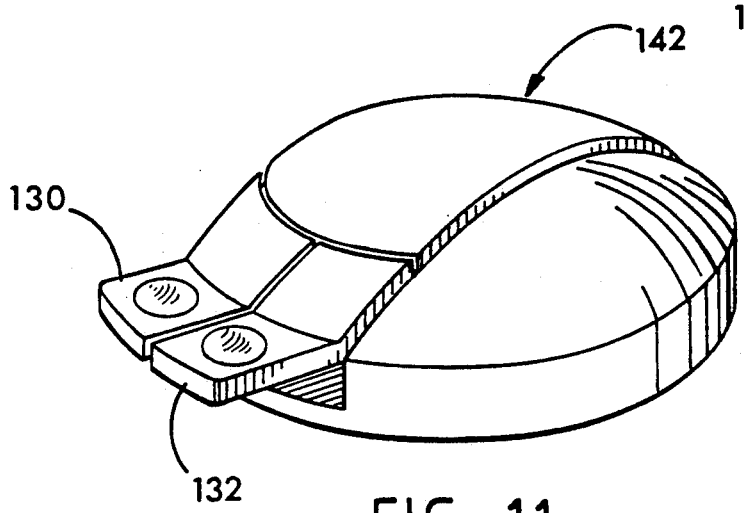
Figure 12:
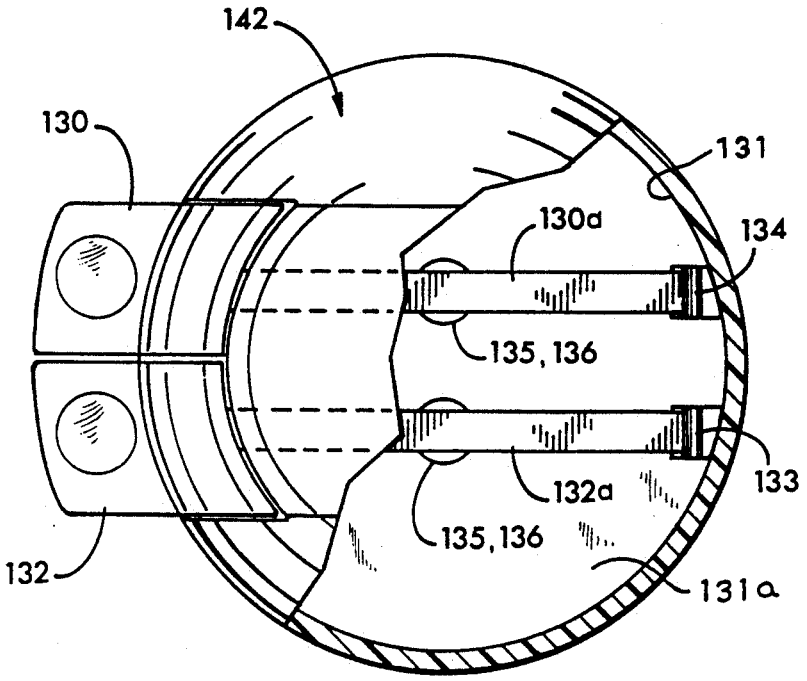
Figure 13:
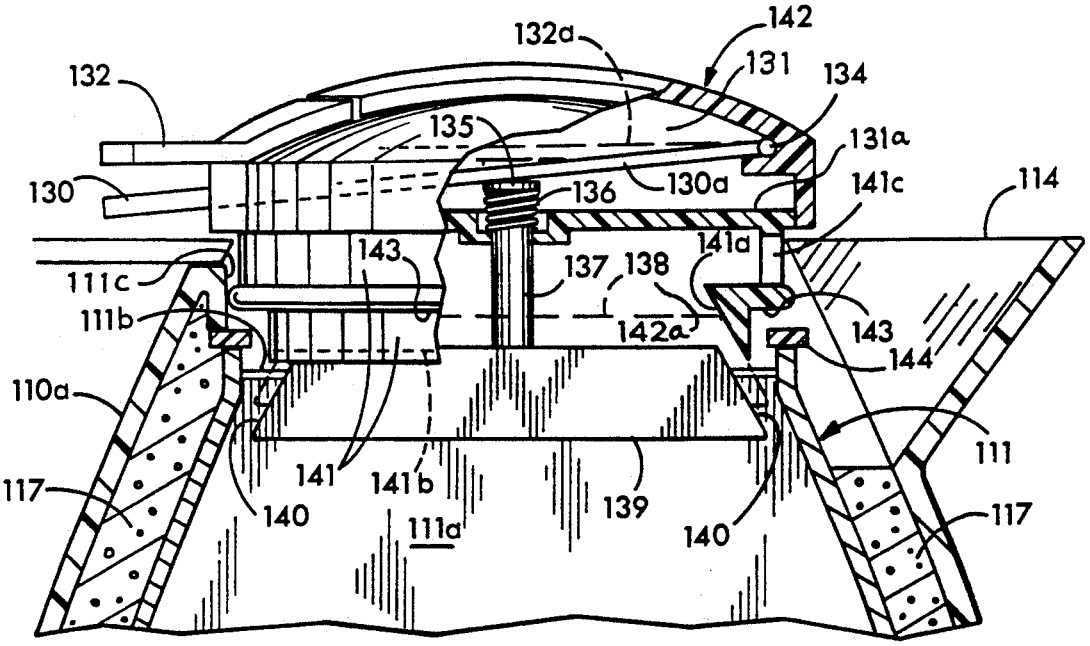
Figure 14:
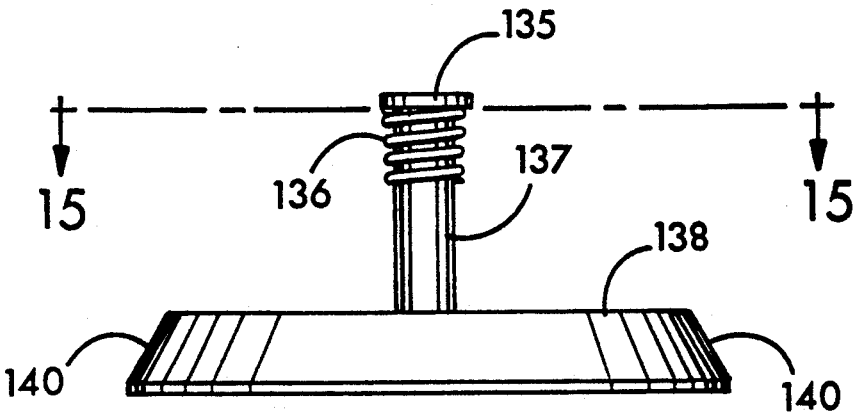

FIG. 10*a* is an enlarged view of the seal between the cover and the partition;

FIG. 11 is a perspective view of the cover;

FIG. 12 is a top view of the cover partly broken away;

FIG. 13 is a vertical sectional view of the top portion of the dispensing container as seen in FIG. 8 on an enlarged scale;

FIG. 14 is a side view of the valves; and

Figure 15:
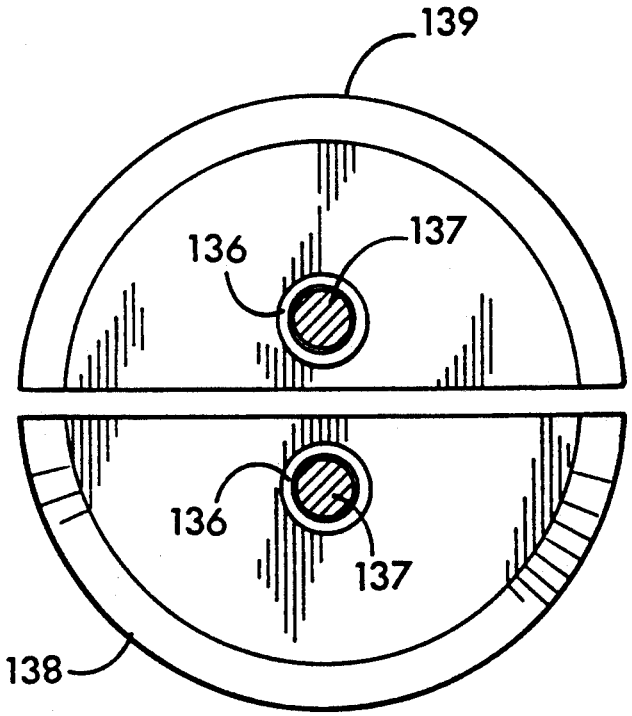

FIG. 15 is a top view of both valves taken on line 15—15 of FIG. 14.

DETAILED DESCRIPTION OF THE INVENTION

Figure 1:
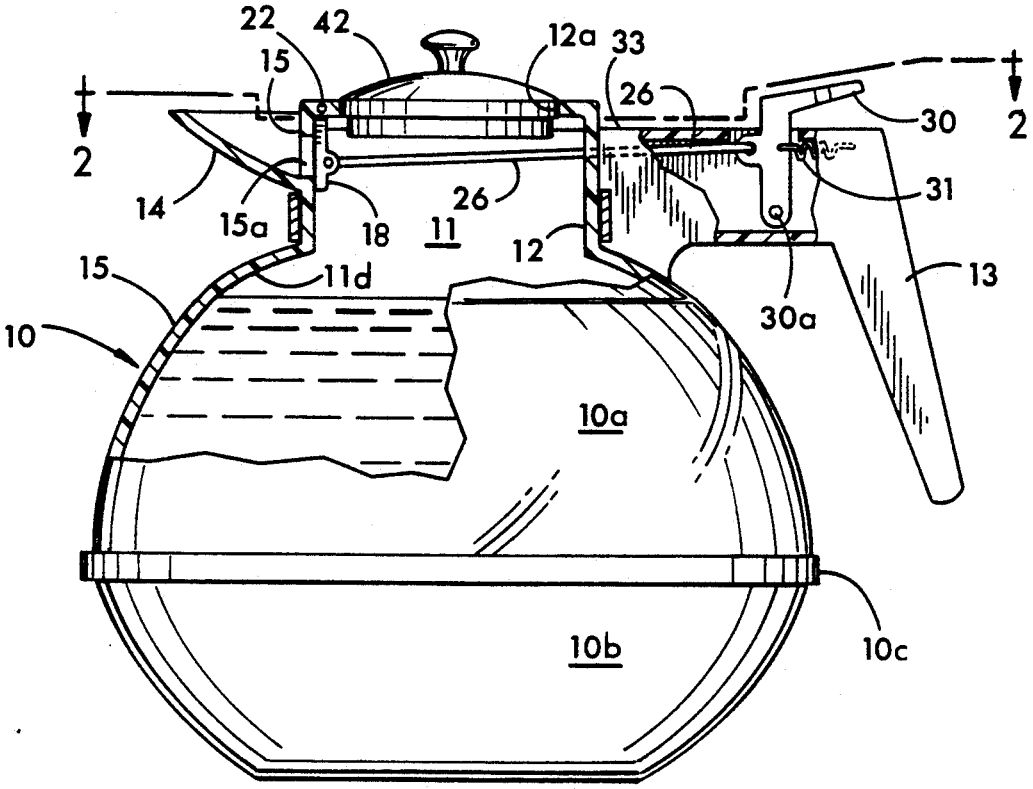
FIG. 1 is a side view of one example of the invention.

Shown in FIG. 1 is a portable beverage dispensing container in accordance with one form of the invention that can be used for keeping coffee and decaffeinated coffee hot on a heating rack for use either in the home or by a server in a restaurant or hospital.

The container or pot indicated generally by the numeral 10 includes a nearly round bowl portion including an upper bowl portion 10*a*, in this case formed from plastic (preferably transparent plastic) and a lower bowl portion 10*b*, preferably formed from metal, joined to portion 10*a* by means of a seam 10*c*. If desired, the container 10 can be formed from other materials such as glass or composed entirely from metal. At the top of the bowl portion 10*a*, 10*b* is an upright, upwardly extending tubular neck portion 12 that terminates in an upwardly opening upper wide mouth 12*a* which because of its large size facilitates filling of the container 10.

While the neck portion 12 in this case is depicted as having a height of about one to two inches and distinct from the bowl portions 10*a* and 10*b*, it can if desired simply comprise an upper portion of the side walls of the pot; e.g., if the side walls were straight up and down, i.e., straight vertical side walls.

Figure 3:
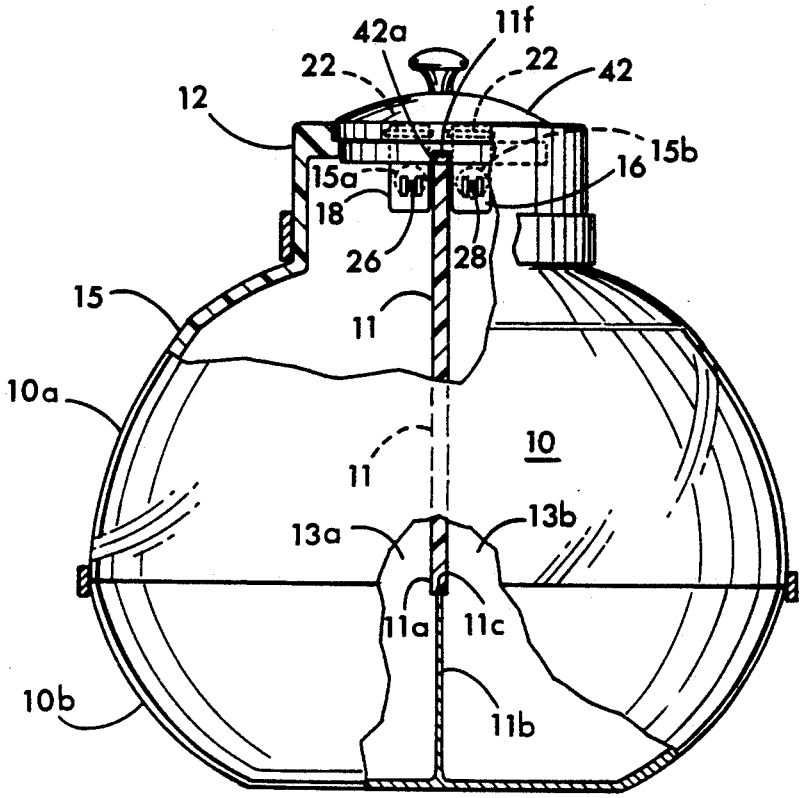
FIG. 3 is a partially broken away rear view of the container of FIGS. 1 and 2.

Inside the container 10 is a vertical, centrally located upright partition 11 which, as can be seen in FIG. 3, includes upper and lower portions 11*a* and 11*b*, respectively, that are permanently joined together at 11*c*. The lower portion 11*b* can be formed from metal when the lower part 10*b* of the container 10 is metal, and the upper portion 11*a* of the partition can be formed of plastic when the upper part 10*a* of the container 10 is plastic. If the container 10 is formed from glass, then the partition 11 can be a single piece of glass or metal. The partition 11 is either sealed to or integral with the container body along its side edges, for example as shown in FIG. 1 at 11*d*. This divides the container 10 into two separated side-by-side compartments 13*a* and 13*b* for holding different beverages, preferably regular and decaffeinated coffee, respectively.

Figure 2:
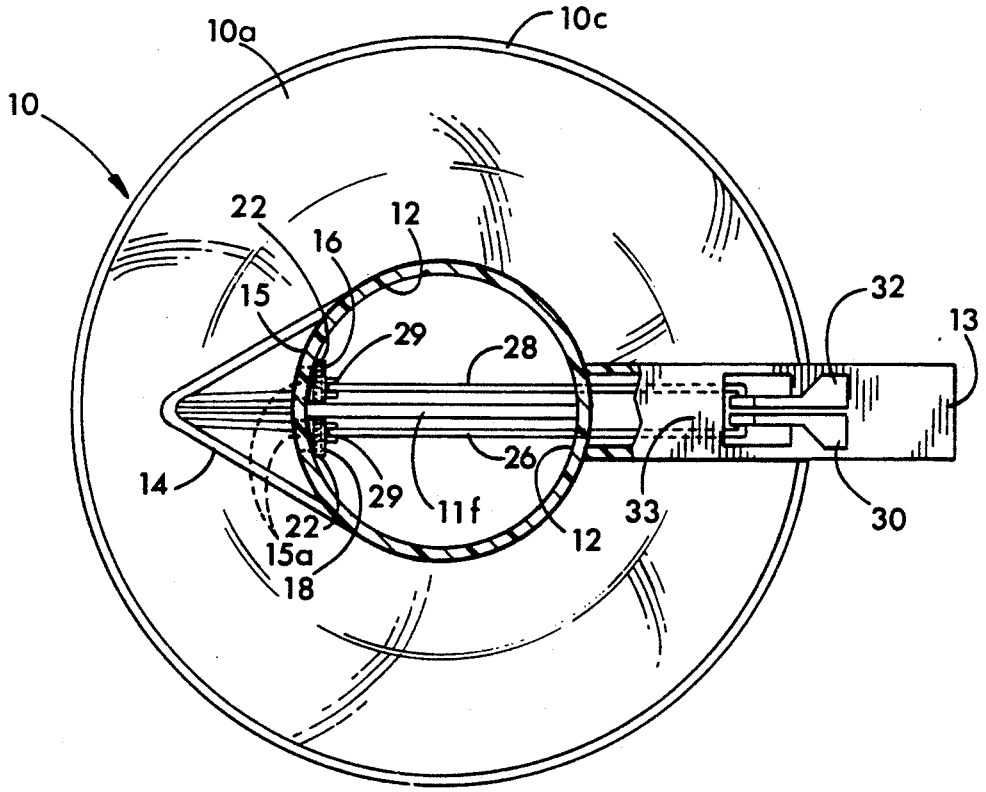
FIG. 2 is a top view taken on line 2—2 of FIG. 1.

A lid 42 is sized to fit into the mouth 12*a* of the neck 12. It can be seen in FIGS. 1 and 3 that the partition 11 includes a top portion that extends through the neck 12 proximate to the open mouth 12*a*. An upper sealing surface 11*f* (FIG. 2 and 3) is provided at the top of the partition 11. It is the sealing surface 11*f* that is sealed by the lid 42 when the lid is placed on the container 10 to prevent mixing of the beverages on opposite sides of the partition.

The container 10 is provided with a carrying handle 13 that enables the container to be easily grasped and carried by hand. A pair of dispensing levers 30, 32 are pivotally mounted upon a pivot 30*a* at the top of the handle 13, in this case for pivotal movement about a horizontal axis. It will be noted that the dispensing levers 30, 32 include slightly inclined rearwardly projecting, upwardly facing surfaces just above the handle 13 that allow easy operation with the thumb. Each of members 26, 28 is connected to one of levers 30, 32 at a point above the pivot for moving one of valve elements 16, 18 away from septum 15 when the top portion of the levers 30, 32 is pressed downwardly. The thumb can be used to press either of the levers 30, 32 downwardly using a natural grasping action of the thumb in which the thumb is moved downwardly toward the center of the hand. This enables either of the levers 30, 32 to be pressed easily and quickly by using a natural movement that is simple to perform while the container 10 is being carried and as the liquid is being dispensed. It can also be seen that the movement of the thumb will not in any way interfere with the grip on the handle 13 required to hold the container 10 while the beverage is being poured. The container of the present invention is therefore very easy to use. The exposed portion of the levers 30, 32 can be marked to indicate regular or decaffeinated coffee.

Figure 4:
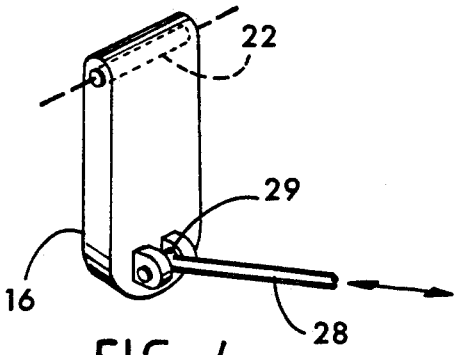
FIG. 4 is a perspective view of one of the dispensing valves shown in FIGS. 1-3.

On the opposite side of the neck 12 from the handle 13 is a pour spout 14. It will be noticed that a portion of the neck 12 adjacent to the pour spout 14 forms an upright septum 15 between the spout 14 and the center of the neck 12. Provided in the septum 15 on each side of the partition 11 are openings 15*a* and 15*b*. Movable valves 16, 18 cover the openings 15*a*, 15*b* in the septum 15. The valves in this case are flap valves, each mounted from a hinge 22 at its upper edge as seen in FIGS. 3 and 4. The valve elements 16, 18 are normally held shut by means of a closing spring 31, only one of which is shown in FIG. 1. In the alternative, a spring can be mounted directly on the hinge pin 22, if desired, to hold the valves 16, 18 in the closed position. It will thus be seen that the movable valves 16, 18 are each normally held shut to close one of the openings 15*b*, 15*a* in the septum 15 on each side of the partition 11.

Elongated actuator members 26, 28, e.g. a rod or cable, are located in the neck 12 on opposite sides of the partition 11 for connecting the respective levers 30, 32 and the valve elements 18, 16 by means of pivots 29 (FIG. 2) to enable a selected valve 16 or 18, as the case may be, to be opened by pressing with the thumb on one of the levers 32 or 30, respectively.

It will be noticed that the location, positioning and operation of the levers 30, 32 will enable the user to easily dispense beverage from either of the chambers 13*a*, 13*b* while the container 10 is being carried by handle 13 as explained above. In addition, the container 10 is easy to fill and clean. It should be noticed that each of the chambers on opposite sides of the partition 11 is easy to fill because of the wide open mouth 12*a*. The chambers 13*a*, 13*b* can still be reliably sealed from one another by the engagement between the lid 42 and the upper sealing surface 11*f* of the partition 11. It can also been seen that the actuator rods or cables 26, 28 are hidden when the container 10 is in use because they pass through a hollow portion of the handle 13 beneath an upper horizontal wall 33. This gives the container 10 a neat appearance.

Figure 4A:
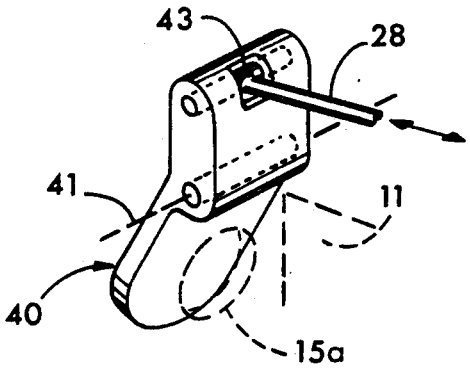
FIG. 4A is an alternative form of dispensing valve.

Refer now to FIG. 4A which shows one alternative form of movable valve member in accordance with the invention. As shown in FIG. 4A there is provided a flap valve 40 having a centrally located hinge pin 41. The actuator rod or cable 28 is connected to its top edge at 43. In this case the lower portion of a movable flap valve 40 is mounted on the outer surface of the septum 15 adjacent the opening 15*a* so that when the actuator rod 28 is pulled toward the right in FIG. 4A, the bottom portion of the valve 40 will move toward the left in the figure, away from its normal position sealing the dispensing opening 15*a*.

Figure 5:
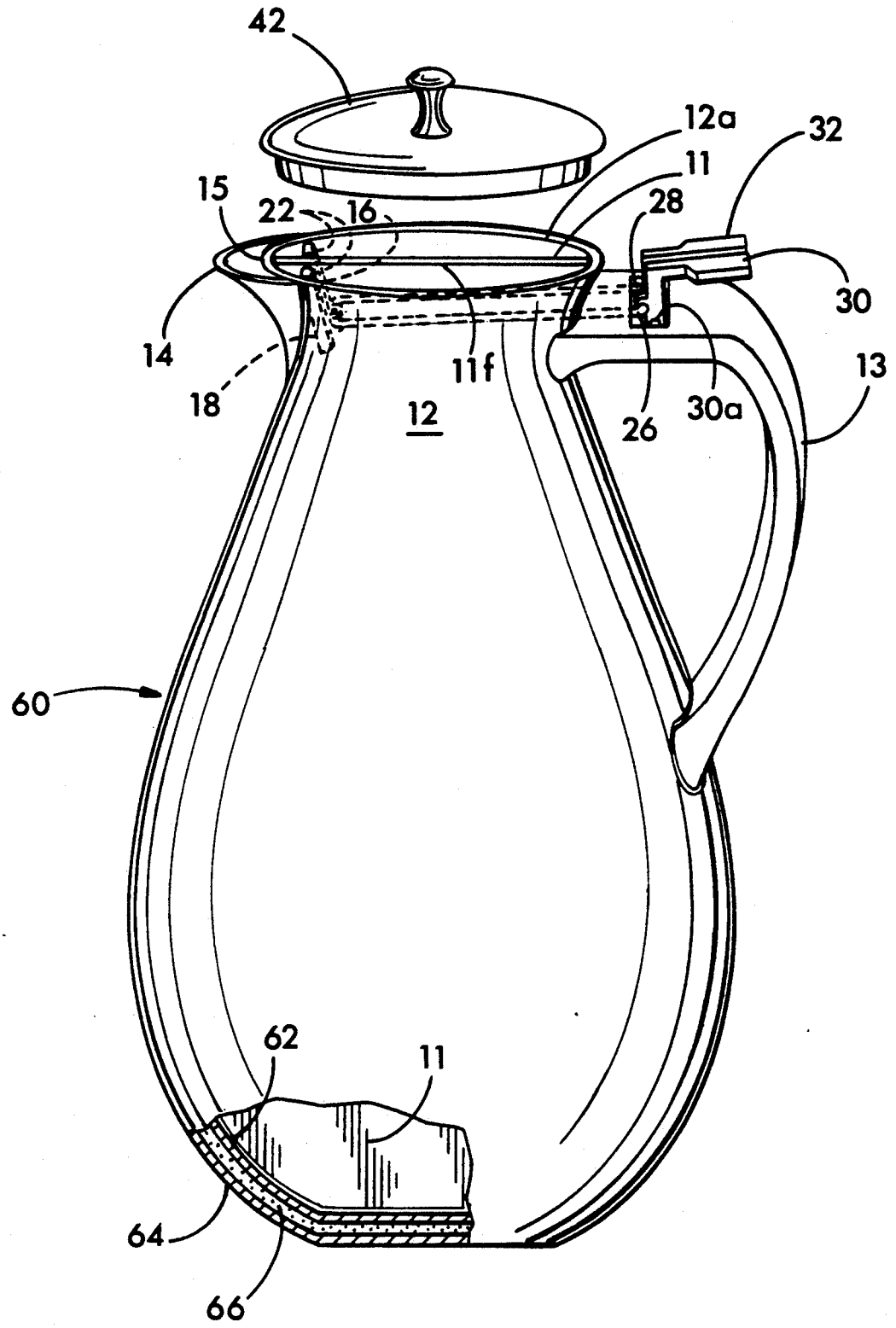
FIG. 5 is a perspective view showing the invention used in an insulated serving pitcher.

Refer now to FIG. 5 which illustrates how the invention is applied to an insulated beverage container or pitcher 60 of the type which is not used with a hot plate but is filled with a beverage, e.g. in this case regular and decaffeinated coffee, and is placed on a table, for example on the table of a restaurant, to enable customers to serve themselves. The same numbers have been used to illustrate corresponding parts already described in connection with FIG. 1-4. The size and proportion of the parts have been adapted to fit the pitcher 60.

As shown in FIG. 5, the pitcher 60 includes inner and outer walls 62, 64 separated by an insulating space 66 which can be filled with an insulating material such as foam plastic or can be evacuated to help keep the beverage contained in the pitcher 60 either hot or cold as required. In the manner already described, partition 11 divides the container into a pair of side-by-side chambers which contain different beverages, usually coffee and decaffeinated coffee. When the pitcher 60 is to be used, the chambers on opposite sides of the partition 11 are filled with the desired beverage and the cover 42 is placed in the open mouth 12*a* at the top of the neck 12 to make a seal with the sealing surface 11*f* of the partition 11. The pitcher 60 is then carried by means of the handle 13 and the thumb is used to depress either of the levers 30, 32 selectively as required to open either of the valves 18 or 16, respectively, for dispensing regular or decaffeinated coffee as desired. By partially depressing both levers, a mixture can be easily dispensed if desired.

Figure 6:
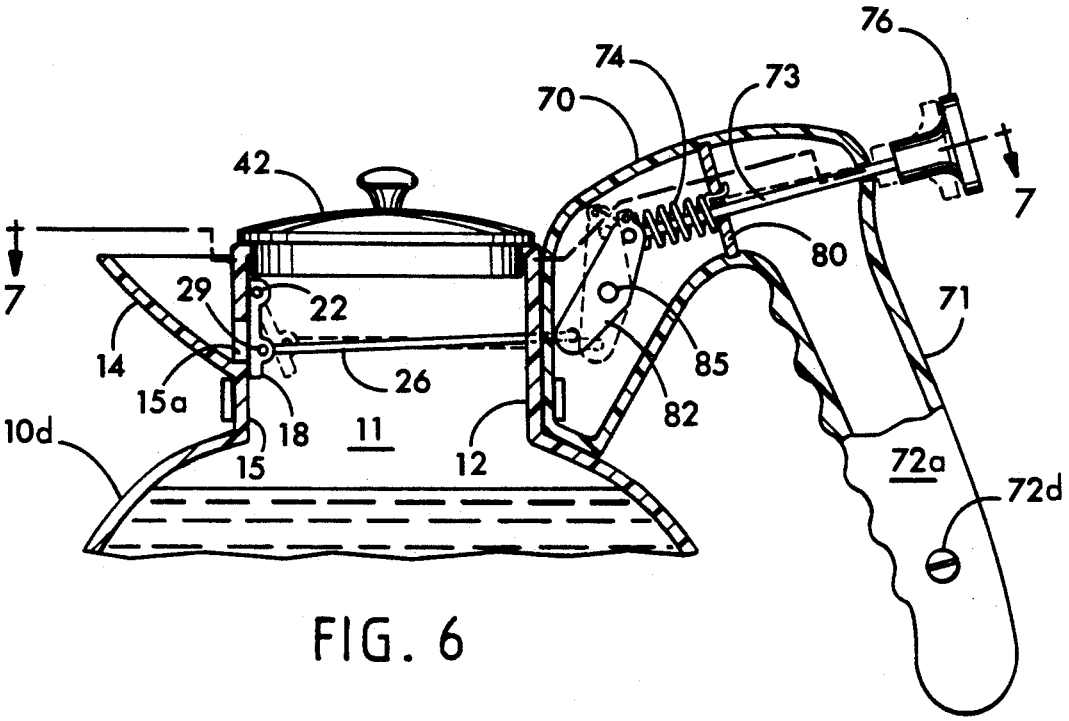
FIG. 6 is a partial vertical sectional view of another embodiment.
Figure 7:
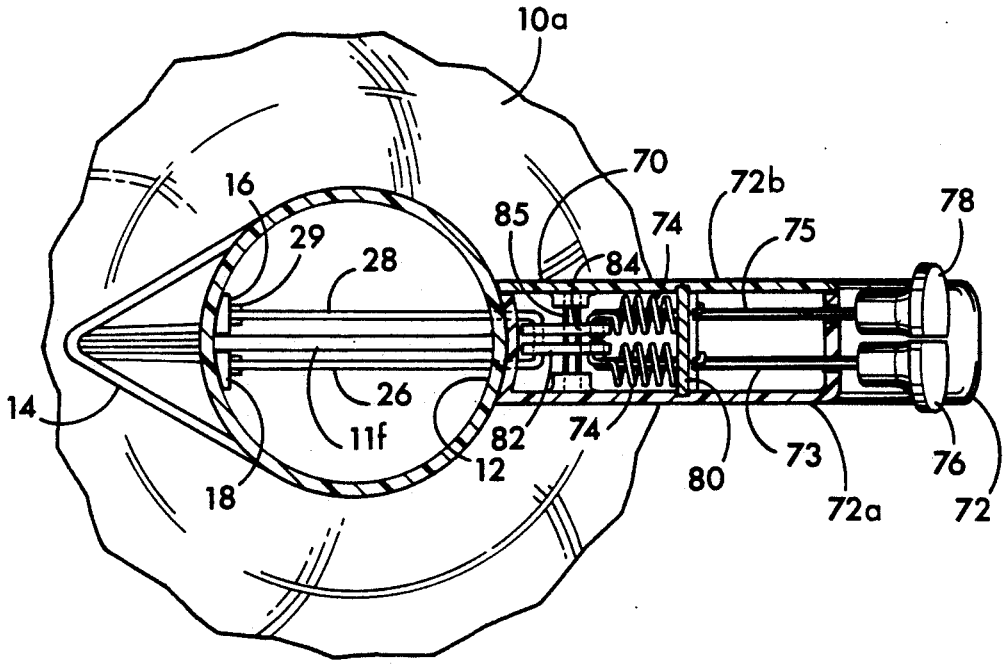
FIG. 7 is a horizontal sectional view taken on line 7—7 of FIG. 6.

Refer now to FIGS. 6 and 7 which illustrate another form of the invention wherein the same numerals are used to refer to corresponding parts already described. In this form of the invention, a handle 70 is provided which extends upwardly somewhat above the top of the neck 12. The handle 70 includes a downwardly and rearwardly extending gripping portion 71. On each side of the handle 70 are provided a pair of removable covers 72*a* and 72*b* which can be secured in place, for example by means of a snap-fit connection or with screws 72*c*. Enclosed inside the handle 70 are a pair of left and right slidably mounted operating levers 73, 75, each formed from a metal rod or a short section of stiff wire slidably mounted for reciprocation within laterally spaced apart openings in a support plate 80. The levers 73, 75 project through openings in the rear of the handle 70 and have operating buttons 76, 78, respectively, affixed to their free, i.e., rearward ends. Pivotally mounted on a horizontal shaft 85 secured within the handle 70 are a pair of laterally spaced apart independently movable rocker arms 82 and 84 which are pivotally connected at their upper ends to the operating levers 73, 75, respectively. At their lower ends, rocker arms 82 and 84 are pivotally connected to the elongated actuator members 26, 28 that are secured as described by means of pivots 29 to the valve members 18, 16, respectively. Connected between the support plate 80 and the upper ends of the rocker arms 82, 84, and surrounding the levers 73, 75, are return springs 74 which yieldably bias the levers 73, 75 toward the right in the figures and in turn urge the valves 16, 18 toward the left to hold them normally in a sealed position over the openings 15*a*. When either of the operating levers 73, 75 is moved forwardly, that is to say, along an axis extending toward the left and inclined somewhat downwardly as shown in FIG. 6, the rocker arm 82 or 84 connected to it will be pivoted in a counterclockwise direction as shown by dotted lines in FIG. 6, thereby opening a selected one of the valves 16, 18 via one of the elongated connector members 26, 28.

It will thus be seen that during use the server can easily support the pot 10 by the gripping portion 71 of the handle 70 and, with the thumb in a comfortable position, readily depress a selected one of the operating buttons 76, 78 to move one of the operating levers 73, 75 toward the left in the figures, opening one of the valves 16, 18. As soon as either of the buttons 76, 78 is released, one of the springs 74 will return the valve 16 or 18 to its seated position as shown in solid lines in FIG. 6. In this way, the operating levers 73, 75 and the operating buttons 76, 78 enable the dispensing container 10 to be operated easily without the requirement for awkward or unfamiliar hand movements.

Another form of the invention will now be described with reference to FIGS. 8-15. Briefly, in the embodiment of FIGS. 8-15, a pair of valves are contained within and form a part of the cover. A vertical partition divides the container into two compartments. The cover includes a lower sealing surface between the valves which engages and forms a seal with the top edge of the partition. The valves are located within the cover on either side of the seal area, and each valve is connected to an operating lever which is exposed on the cover in a position that allows it to be easily operated by the user so that by depressing one or the other of the levers, either one of the valves on opposite sides of the partition is opened. This allows the beverage within the corresponding compartment to flow past the valve upwardly into the cover and then through an outlet opening into the spout of the beverage dispenser.

Refer now to FIGS. 8-15 which illustrate an insulated dispensing vessel or container 110 having inner and outer shells 111 and 112, respectively, which are preferably spaced apart by an insulating layer such as a layer of foamed-in-place insulation 117. The outer shell 112 is divided into two portions: an upper portion 110*a* and a lower portion 110*b* which, to facilitate assembly, are connected along separation line 110*c*. The inner shell or vessel liner 111 is provided with a vertically disposed partition 111*a* which extends from the front of the inner shell 111 to the rear and is integral therewith along its edges to divide the container 110 into two compartments 119*a* and 119*b* for holding two beverages such as regular and decaffeinated coffee, respectively.

Figure 9:
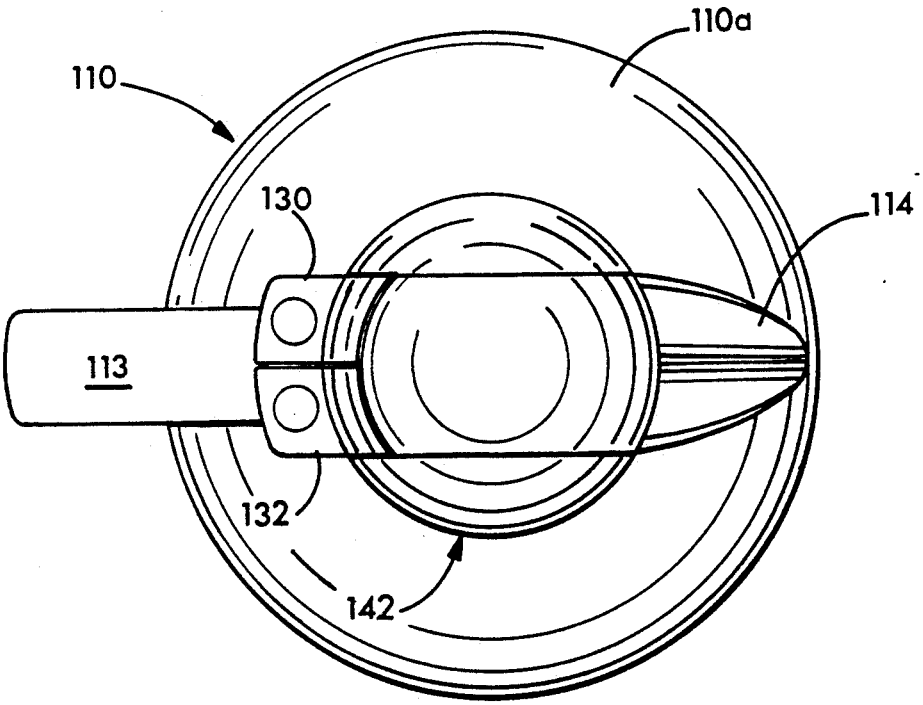
FIG. 9 is a top view of FIG. 8.

Above the partition 111*a* is an upper open mouth 111*c*. At the rear of the container 110 is provided a handle 113 that is integral with the outer portion 110*a* of the container. In a diametrically opposed position to the handle 113 as seen in FIGS. 8 and 9 is a pour spout 114 which communicates with the interior of the container through outlet openings 141*c* and 141*d* of the cover 142, as will be described more fully hereinbelow.

Refer now especially to FIGS. 10-13 which best illustrate the cover 142. The cover 142 is generally circular in outline in this instance since the container 110 has a circular upper open mouth 111*c*. However, if the mouth 111*c* is square, oval or of some other shape, the cover 142 should have a corresponding configuration to provide a good fit. Within the mouth 111*c* above the partition 111*a* is a circular rubber sealing gasket 144. The cover 142 includes a downwardly extending lower portion 141 with a circular shoulder 143 (FIGS. 8, 10 and 13) for forming a seal against the rubber gasket 144 to reliably prevent leakage. Within the top portion of the cover 142 are mounted left and right valve operating levers 130 and 132 with exposed ends at the left in the figure which can be pressed downwardly with the thumb as the handle 113 is being held for dispensing either of the beverages desired. The levers 130, 132 include horizontally disposed lever arm portions 130*a*, 132*a* connected by means of pivots 134, 133, respectively, to the cover 142. As shown in FIGS. 12 and 13, the lever arm portions 130*a*, 132*a* are located in a chamber 131 within the cover 142 above a divider 131*a*. Mounted above the divider 131*a* beneath the lever arm portions 130*a*, 132*a* are valve operating compression springs 136. Each spring is connected to a valve stem 137 of the right and left valves 138, 139, respectively, by a retaining washer 135 secured to the end of the stem. The washer 135 is positioned below the lower surface of the corresponding lever arm portion 130*a*, 132*a*. Compression springs 136 hold the valves 138 and 139 in a normally closed position.

The cover 142 has a bottom wall 137 (FIG. 10) with a transversely extending groove 141*b* for forming a seal with a similarly shaped upper sealing surface 111*b* of the partition 111*a* (FIG. 10*a*). When the cover 142 is pushed into the mouth 111*c* of the vessel, the groove 141*b* will engage the corresponding upper sealing surface 111*b* of the partition 111*a* to create a seal for preventing the contents of the chambers 119*a* and 119*b* from becoming mixed.

On either side of the sealing surface 141*b* are similar valve ports. The semicircular valve port 141*a* for valve 139 can be seen in FIG. 13. The port for valve 138 (not shown in FIG. 13) has a similar semicircular shape. The springs 136 normally hold both of the valves 138, 139 in a closed position. The ports for both valves 138 and 139 communicate with an outlet duct 142*a* in cover 142 which receives the coffee passing out through whichever one of the valves 138, 139 is held open. Coffee within the duct 142*a* flows through the outlet openings 141*c* and 141*d* into the spout 114 and from there into a coffee cup.

During operation, the user merely presses downwardly on either one of the exposed end portions of the levers 130 or 132, depending upon whether regular or decaffeinated coffee is desired, causing the corresponding lever arm 130*a* or 132*a* to press downwardly on the washer 135 at the upper end of the corresponding valve stem 137, thereby forcing either one or the other of the valves 138, 139 off its port so that when the container is tipped forwardly the coffee will flow through the open valve port into the duct 142*a* above the valves 138 and 139, then out through the openings 141*c* and 141*d* into the spout 114 and into a coffee cup. If both levers 130, 132 are depressed, the coffee will flow out from both of chambers 119*a* and 119*b*.

Many variations of the present invention within the scope of the appended claims will be apparent to those skilled in the art once the principles described herein are understood.

What is claimed is:

1. A serving container for selectively dispensing one of two beverages, comprising:

a beverage serving container body including a liquid holding vessel having an upper open mouth at the top thereof and a vertically disposed partition therein to divide the vessel into a pair of laterally disposed left and right compartments for holding beverages;

a cover having a lower surface adapted to fit within the mouth at the top of the vessel;

said partition having a horizontally disposed sealing edge at the top thereof between the compartments;

said cover having a diametrically extending, downwardly facing sealing surface adapted to engage the sealing edge of the partition to form a seal therewith to prevent mixing of the contents of the compartments when the cover is in place on the container;

left and right valves mounted in the lower surface of the cover on opposite sides of the sealing surface;

said cover having an outlet port; and said cover having duct means communicating between the valves and the outlet port of the cover so that when one of the valves in the lower surface of the cover is opened the beverage on the same side of the partition can be dispensed from the vessel through the outlet port of the cover.

2. The serving container of claim 1 wherein the lower surface has a groove extending diametrically thereacross for defining the sealing surface of the cover and the groove in the cover is adapted to engage and form a seal with the sealing edge of the partition.

3. The serving container of claim 1 wherein each valve is a normally closed vertically movable valve member, a resilient means is provided for closing each of the valves, and an operating lever is operatively associated with each valve for moving either valve selected from a closed to an open position.

4. The serving container of claim 3 wherein each of the valve operating levers comprises a lever arm pivotally connected to the cover at one end and having an exposed end portion to which manual pressure can be applied by the user to open either one of the valves selected.

5. The serving container of claim 1 wherein said cover includes an upper compartment having a divider therebelow, a pair of horizontally extending parallel laterally disposed left and right lever arms are pivotally connected to the cover within the compartment above the divider, each of the lever arms has at the opposite end from said pivotal connection an operating end portion that is exposed for being operated with the hand of a person serving the beverages, the cover has inlet ports on its lower surface, the valves are left and right valves positioned respectively below the right and left lever arms within said ports, each of the valves has a valve stem projecting upwardly through the divider, compression springs are mounted upon the valve stems and each of the lever arms is positioned to exert downward pressure on one of the valve stems for opening the valve mounted on the lower end thereof.

6. The serving container of claim 5 wherein the cover has a downwardly facing shoulder on an outside surface thereof, a sealing gasket formed from resilient material is mounted in the mouth of the vessel in a position to engage the shoulder when the cover is in sealing engagement with said sealing edge at the top of the partition.

7. The serving container of claim 1 wherein each of the valves is a poppet valve having a head and an upwardly extending vertically disposed valve stem, the cover has a pair of valve stem openings therein, the valve stem extends upwardly through said openings, and compression springs are mounted upon a portion of each of the valve stem above the valve stem openings.

* * * * *